US006493974B2

(12) United States Patent
Tramont

(10) Patent No.: US 6,493,974 B2
(45) Date of Patent: Dec. 17, 2002

(54) SIGN HOLDER WITH CHANGEABLE DISPLAY

(75) Inventor: Richard D. Tramont, St. Louis, MO (US)

(73) Assignee: SBPI, Inc., St. Louis, MO (US)

( * ) Notice: Subject to any disclaimer, the term of this patent is extended or adjusted under 35 U.S.C. 154(b) by 0 days.

(21) Appl. No.: 09/682,538

(22) Filed: Sep. 17, 2001

(65) Prior Publication Data

US 2002/0026737 A1 Mar. 7, 2002

(51) Int. Cl.[7] ..... G09F 7/02
(52) U.S. Cl. ..... 40/611; 40/5; 40/618
(58) Field of Search ..... 40/611, 605, 606, 40/618, 5, 649

(56) References Cited

U.S. PATENT DOCUMENTS

| | | | | | |
|---|---|---|---|---|---|
| 895,320 | A | * | 8/1908 | Wilt | 40/611 |
| 1,816,776 | A | | 7/1931 | Haslun et al. | |
| 1,822,492 | A | | 9/1931 | Lamb | |
| 1,822,641 | A | * | 9/1931 | Angell | 40/5 |
| 1,862,776 | A | * | 6/1932 | Timberlake | 40/606 |
| 2,134,833 | A | * | 11/1938 | Morton | 40/611 |
| 2,162,025 | A | | 6/1939 | McClaughry | |
| 2,297,574 | A | | 9/1942 | McCord | |
| 3,596,387 | A | * | 8/1971 | Hoeve et al. | 40/661 |
| 3,719,000 | A | * | 3/1973 | Finger | 40/609 |
| 3,914,890 | A | | 10/1975 | Behlen, Jr. | |
| 3,982,342 | A | | 9/1976 | Moore | |
| 4,112,604 | A | * | 9/1978 | Ott et al. | 40/610 |
| 4,138,787 | A | | 2/1979 | Sarkisian et al. | |
| 4,679,341 | A | | 7/1987 | Goldman | |
| 4,791,739 | A | | 12/1988 | Hetzer | |
| 4,916,840 | A | * | 4/1990 | Getz | 40/605 |
| 5,257,472 | A | * | 11/1993 | Harnois et al. | 40/606 |
| 5,377,434 | A | | 1/1995 | Wilson | |
| 5,588,238 | A | * | 12/1996 | Visocky et al. | 40/575 |
| 6,009,651 | A | | 1/2000 | Current | |
| 6,178,679 | B1 | * | 1/2001 | Dundorf | 40/575 |

* cited by examiner

*Primary Examiner*—William L. Miller
(74) *Attorney, Agent, or Firm*—Senniger, Powers, Leavitt & Roedel

(57) ABSTRACT

A sign holder for displaying a second sign at a position adjacent a first sign and which facilitates readily changing the second sign to alter the information displayed on the second sign. The holder includes a base member having a rigid support portion and a display portion. The rigid support portion is sized and shaped for being received by a frame supporting the first sign. The holder is held in an upright orientation with the display portion of the base member disposed adjacent to the first sign. A sign mount on the display portion mounts the second sign on the holder to display the second sign. The sign mount is configured for selectively interchanging the second sign with a different second sign to change the information displayed without altering the first sign.

21 Claims, 7 Drawing Sheets

SIGN HOLDER WITH CHANGEABLE DISPLAY

BACKGROUND OF THE INVENTION

This invention relates generally to promotional signs, and in particular to a sign holder for displaying a second sign at a position adjacent a first sign and which facilitates readily changing the second sign to alter the information displayed.

Signs which display point-of-purchase product information are in widespread use in convenience stores, supermarkets, and department stores, as well as frequently being placed on upper surfaces of gasoline pumps. Frequently, that type of sign has an upright frame for holding a banner with printed information. The banner is a lightweight cardboard or plastic panel which is received through a slot on top of the frame and slid down to a retained, upright position where the banner is loosely held along its sides. A second banner may be held by the frame, parallel with the first banner but facing the opposite direction. Typically, a rigid divider is also received in the frame between the two banners to provide stability and inhibit inadvertent displacement of the banners, such as by force of wind.

It would be advantageous to increase the size of the sign to provide space for additional information, such as price, or for advertising a second product. Unfortunately, existing frames do not readily facilitate such an increase in size.

Further, it would be advantageous to permit a person to change the information displayed by the sign on a frequent basis. Unfortunately, banners are pre-printed and the content is not changeable without printing all new banners. For example, the price of a product may fluctuate, but production of new banners to reflect an updated price requires a longer period of time and can become a substantial expense. Accordingly, banners which display the updated price are often unavailable.

SUMMARY OF THE INVENTION

Among the several objects and features of the present invention may be noted the provision of a sign holder for an existing sign frame which increases the size of available space for displaying information; the provision of such a sign holder for displaying a second sign at a position adjacent a primary sign; the provision of such a sign holder which facilitates changing the second sign to alter the information displayed on a frequent basis; and the provision of such a sign holder which is reliable in operation.

In general, a secondary sign holder of the present invention displays a second sign at a position adjacent a primary sign holder for displaying a first sign and facilitates readily changing the second sign to alter the information displayed by the secondary sign holder. The primary sign holder includes a frame for supporting the first sign. The secondary sign holder comprises a base member including a rigid support portion and a display portion. The rigid support portion is sized and shaped for reception by the frame of the primary sign holder for holding the secondary sign holder in an upright orientation with the display portion disposed generally adjacent to the primary sign holder. A sign mount on the display portion of the base member mounts the second sign on the secondary sign holder to display the second sign. The sign mount is configured for selectively interchanging the second sign with a different second sign to change the information displayed without altering the first sign.

In another aspect, the present invention comprises a combination of a primary sign holder for displaying a first sign and a secondary sign holder for displaying a second sign at a position adjacent the primary sign holder. The primary sign holder comprises a frame for supporting the first sign, the frame having a top, a bottom, and an opening therein for receiving the first sign. The secondary sign holder comprises a base member including a rigid support portion and a display portion. The rigid support portion is sized and shaped for reception by the frame and through the opening for holding the secondary sign holder in an upright orientation with the display portion disposed immediately adjacent to the primary sign holder. A sign mount on the display portion of the base member mounts the second sign on the secondary sign holder to display the second sign. The sign mount is configured for readily interchanging the second sign with a different second sign to change the information displayed without altering the first sign.

In still a further aspect, a holder according to the present invention displays a second sign at a position adjacent a first sign and facilitates readily changing the second sign to alter the information displayed on the second sign. The first sign is supported by a frame having a top, a bottom, and an opening in the top of the frame. The first sign is received in the frame. The holder comprises a solid, rectangular, and generally flat panel configured to be received through the opening in the top of the frame at a retained position wherein the panel rests generally along the bottom of the frame at an upright orientation and located behind the first sign so that visibility of the first sign is not obstructed by the panel. The panel is sized with a height greater than the frame so that at the retained position, an upper portion of the panel extends above the top of the frame. Upper and lower horizontal, spaced apart tracks on the upper portion of the panel are configured for slidably receiving the second sign to display the second sign. The tracks are configured for selectively interchanging the second sign with a different second sign to change the information displayed without altering the first sign.

In yet a further aspect, a holder according to the present invention displays a second sign at a position adjacent a first sign and facilitates readily changing the second sign to alter the information displayed on the second sign. The first sign is supported by a frame having a top, a bottom, and an opening in the top of the frame, the first sign being received in the frame. The holder comprises a solid, rectangular, and generally flat panel configured to be received through the opening in the top of the frame to a retained position wherein the panel is at an upright orientation with a lower portion of the panel received in the frame and located behind the first sign so that visibility of the first sign is not obstructed by the panel and with an upper portion of the panel extending above the top of the frame. The panel has a bottom edge which at the retained position is spaced above the bottom of the frame. Upper and lower horizontal, spaced apart tracks on the upper portion of the panel are configured for slidably receiving the second sign to display the second sign. The tracks are configured for selectively interchanging the second sign with a different second sign to change the information displayed without altering the first sign. The lower track comprises a support for holding the panel at the retained position, the lower track configured for directly engaging the top of the frame to support the panel such that weight of the panel bears upon the top of the frame.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
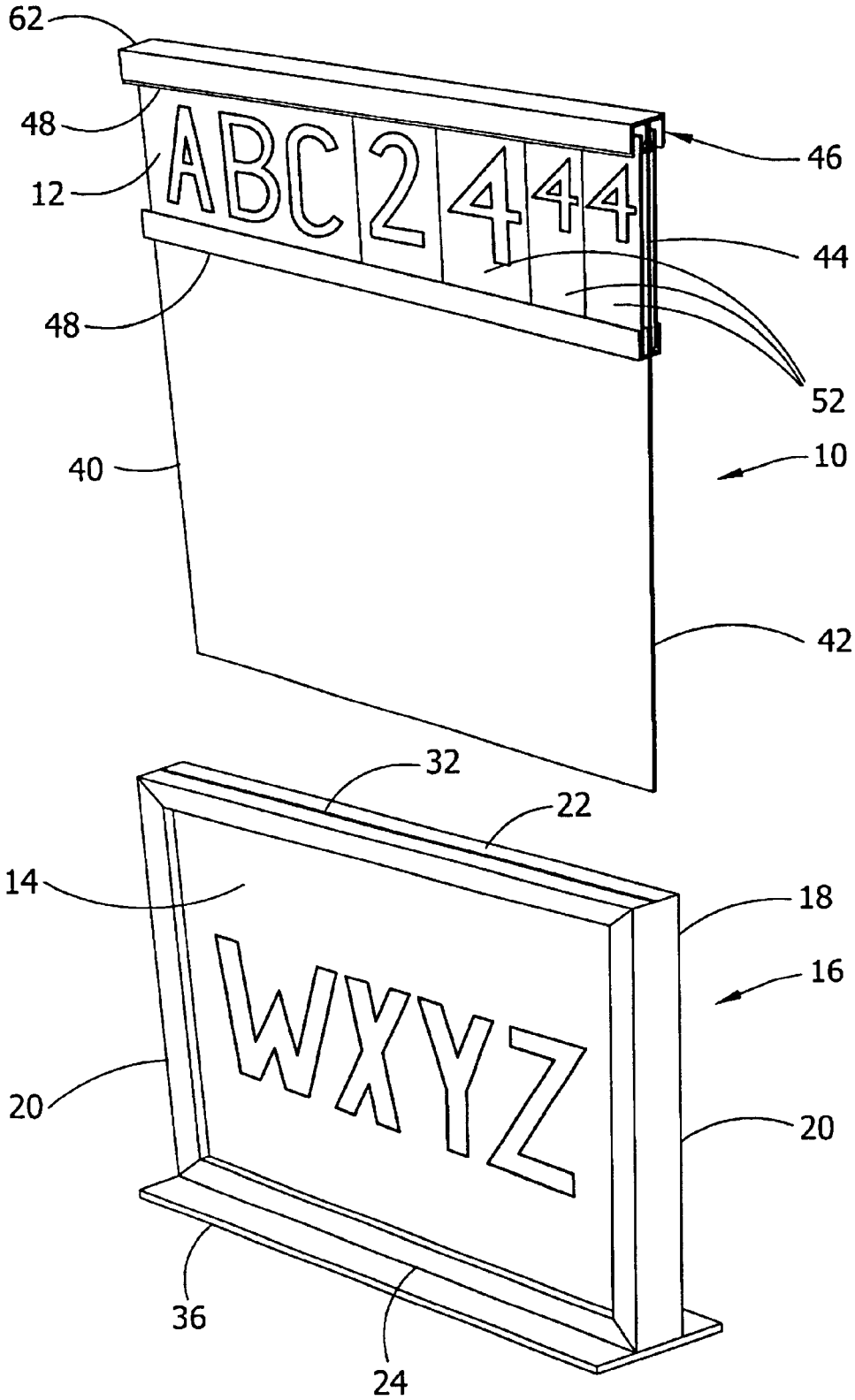
FIG. 1 is a perspective of a sign holder of the present invention exploded from a frame which receives the holder.

Referring now to the drawings and in particular to FIG. 1, a sign holder according to the present invention is indicated generally at 10. The sign holder 10 is designed to display a second sign 12 adjacent to a first sign 14 and thereby increase the space available for displaying information. Because the sign holder 10 holds the second sign 12, it is hereinafter referred to as a secondary sign holder. The first sign 14 is held by a primary sign holder indicated generally at 16. As known to those skilled in the art, the first sign 14 is typically a lightweight banner made of laminated cardboard or thin plastic on which promotional information is printed.

Figure 3:
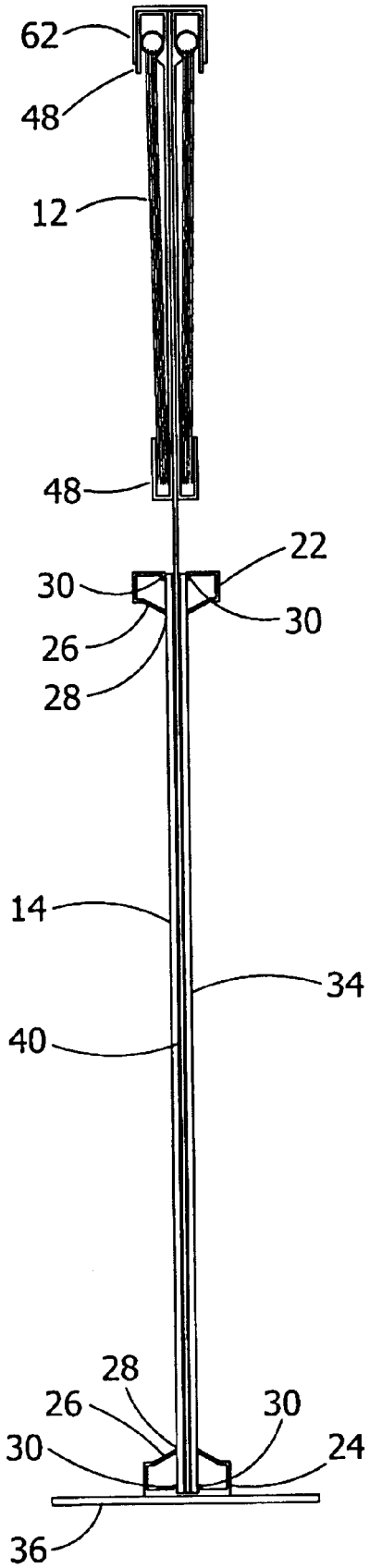
FIG. 3 is a sectional of the sign holder along line 3—3 of FIG. 2.

The primary sign holder 16 includes upright frame 18 configured for supporting the first sign 14. The frame 18 includes a rectangular shaped assembly having two side members 20, a top member 22, and a bottom member 24. Each member of the frame 18 is formed from elongate pieces of sheet metal bent into a channel shape in transverse section (FIG. 3) and configured for receiving an outer peripheral edge portion of the first sign 14. Each member 20, 22, 24 has an inwardly facing wall 26 with a slot 28 extending along the wall for receiving an edge of the first sign 14. Protruding guide members 30 are positioned along an interior of the bottom member 24 and side members 20 for engagement by the edge. The top member 22 has an opening 32 comprising a second slot (FIG. 1) extending along the top of the frame 18 for receiving the first sign 14 and the secondary sign holder 10 when inserted into the frame.

The primary sign holder 16 and first sign 14 have corresponding sizes such that the first sign may be inserted into the opening 32 and slid downwardly with its lateral edges received in the side members 20 and engaging the guide members 30 therein. The first sign 14 comes to rest as shown in FIG. 1, with its weight supported by the bottom member 24 and being loosely held along its edge portions by the four members of the frame 18. An opposite first sign 34 (FIG. 3) may be received by the frame 18, parallel with the first sign 14 but facing the opposite direction.

A generally flat base 36 is provided along the bottom member 24 for supporting the frame 18 in an upright, stable position upon a flat surface (not shown). The base 36 may freely rest on the surface or may be secured to the flat surface by a suitable method such as by application of an adhesive or tape (not shown) along a bottom surface of the base. The side, top, and bottom members 20, 22, 24 of the frame and the base 36 are attached together as by welding at intersections. Each component is made of a suitable rigid material, such as a hard plastic or a metal (e.g., aluminum). It is understood that a primary sign holder 16 of a different configuration, including a frame with a non-rectangular shape, an opening in its side, a different construction, or using a manner of holding signs without channel members, such as clips or adhesive, does not depart from the scope of this invention.

Because the primary sign holder 16 is conventional, it will not be described in further detail.

Figure 2:
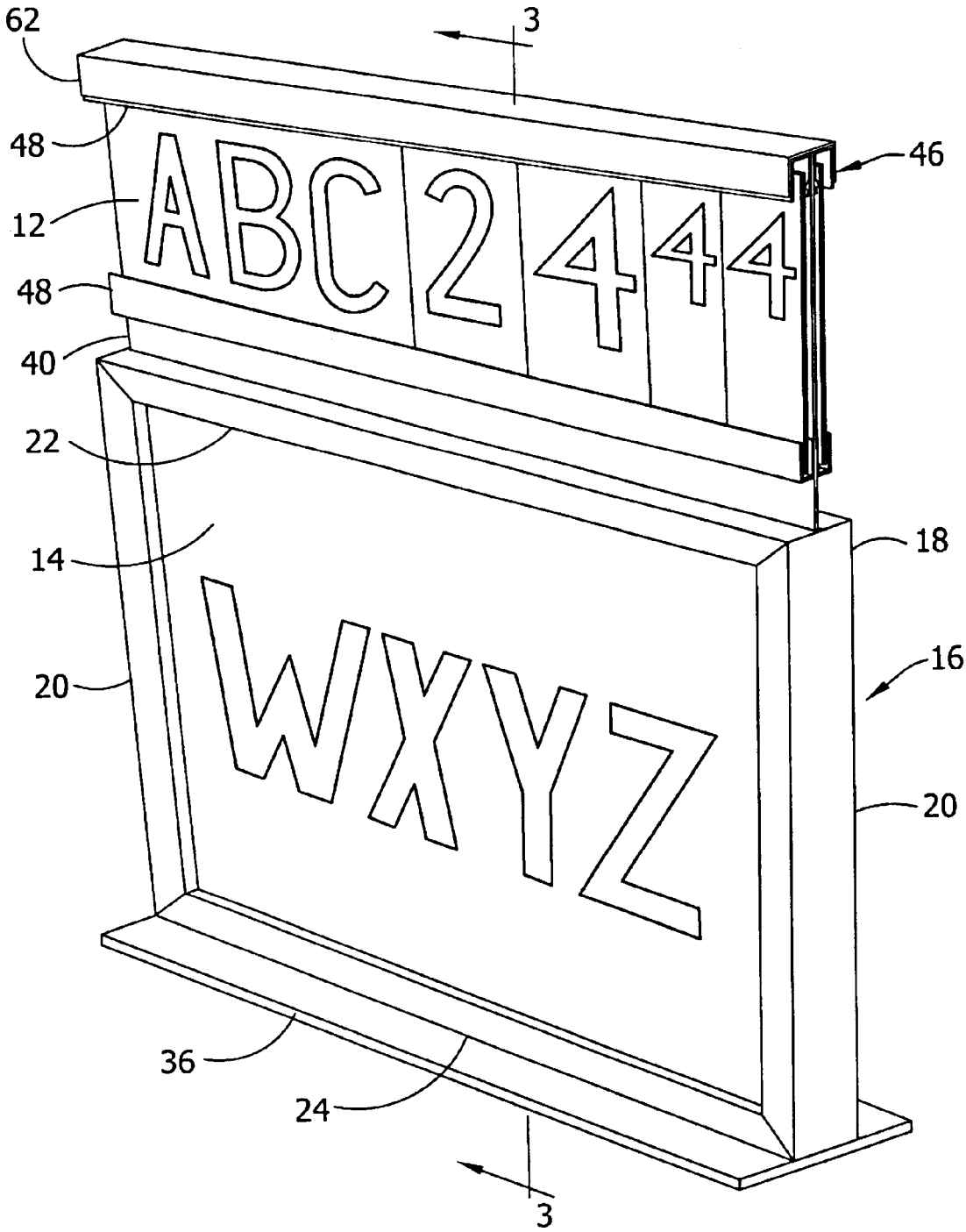
FIG. 2 is a perspective of the sign holder received in and retained by the frame.

The secondary sign holder 10 comprises a base member 40 for holding the second sign 12 adjacent the first sign 14. The base member 40 includes a rigid support portion 42 which is positioned generally beneath a display portion 44. The support portion 42 is sized and shaped for being received by the frame 18 in a retained position (FIGS. 2 and 3) to hold the secondary sign holder 10 in an upright orientation with the display portion 44 disposed generally adjacent to the primary sign holder 16. The second sign 12 increases the size of space available for displaying information relative to a configuration where the frame 18 holds only the first sign 14. Thus, the secondary sign holder 10 functions as an extender for extending the sign upwardly. Use of the second sign 12 is flexible such that the information displayed thereon may relate to the information on the first sign 14, or it may be unrelated.

Preferably, the support portion 42 and the display portion 44 of the base member 40 are integral and define a generally flat, rectangular panel which is continuous and solid. The base member 40 is sized with a height greater than the frame 18 so that when the support portion 42 is received by the frame and slid downwardly to the retained position where it is supported by the bottom member 24 (shown in FIG. 3), the display portion 44 extends above the top member 22. The base member 40 is made of a suitable rigid material such as a metal (e.g., aluminum). It is understood that secondary sign holders 10 of other configurations, including those which are non-flat, non-rectangular, or have discontinuous support and display portions, do not depart from the scope of this invention. For example, the support portion 42 may comprise one or more legs or panel sections which are received in the frame to support the display portion 44.

The base member 40 at the retained position is located behind the first sign 14 so that visibility of the first sign is in no way obstructed by the base member. When an oppositely facing first sign 34 is received in the frame 18, the base member 40 is placed in a sandwiched position (FIG. 3) between the signs 14, 34. The base member 40 provides stability to the first signs 14, 34 and inhibits inadvertent displacement of the first signs, such as by force of wind. Therefore the base member 40 can replace a conventional rigid divider (not shown) which is frequently inserted in the frame 18 for that purpose.

A sign mount, indicated generally at 46, is positioned on the display portion 44 of the base member 40 for mounting the second sign 12. The sign mount 46 is configured for readily interchanging the second sign 12 with a different second sign to change the information displayed, as desired, without altering the first sign 14. For example, a displayed price can be quickly changed without the need for replacing banners of the first sign 14. The sign mount 46 comprises upper and lower spaced apart tracks 48 for slidably receiving the second sign 12 between the tracks. The tracks 48 are arranged with a vertical spacing to correspond with a height of the second sign 12. Each track 48 defines a generally channel shape opening which opens laterally outwardly on least at one end for slidably receiving the second sign. The sign mount 46 is made of a suitable material which is durable, easily formed, and rigid even when exposed to all weather conditions. An exemplary material is an extruded plastic such as Acrylonitrile Butadiene Styrene (ABS).

Preferably, the upper and lower tracks 48 are integral with a web 50 (FIG. 4) extending therebetween. The web 50 is attached to the base member 40 by any suitable method such as by application of double sided adhesive tape. However, the upper and lower tracks 48 may be separate and independently attached to the base member 40 without departing from the scope of this invention. Further, the sign mount 46 may have a configuration different than upper and lower tracks for mounting the second sign 12 without departing from the scope of this invention, such as a plurality of fasteners, adhesive, shelf, or a single track.

For displaying information on both sides of the base member 40, the sign mount 46 includes tracks 48 on an opposite side of the base member which are substantially a mirror image of those on the first side.

Figure 5:
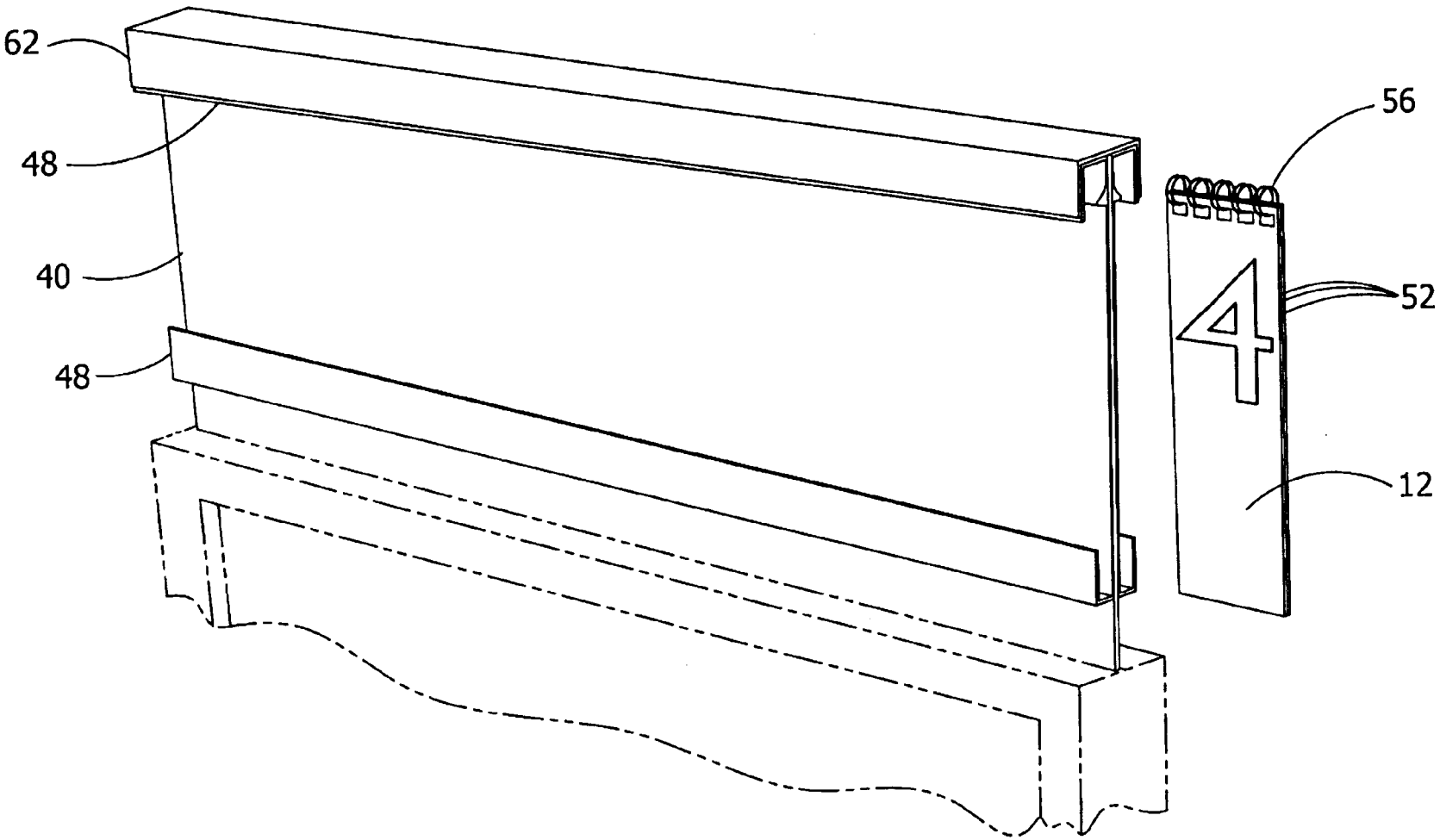
FIG. 5 is a perspective view of the sign holder and a set of price digit cards for mounting thereon.

The second sign 12 comprises a plurality of interchangeable cards 52, each card displaying an advertisement or an individual numeric digit for indicating price. Each card 52 may be singular and independent, or may be bound in a set (FIG. 5) by a spiral binder 56 with other cards showing other products or numeric digits. Each set of cards 52 is slidably received in the tracks 48, and may be changed by removing the set from the tracks, turning to the desired digit, and replacing the set into position in the tracks. The sign mount 46 includes a bump 60 inside the channel or on the web 50 configured for supporting the spiral binder 56 and positioning the cards 52. It is understood that the second sign 12 may comprise a single panel (in lieu of a plurality of cards 52 in tracks) without departing from the scope of this invention.

A transparent, thin plastic cover (not shown) may be placed in front of the second sign 12, slidably received in the upper and lower tracks 48 to protect the cards 52 from moisture or dirt.

Figure 4:
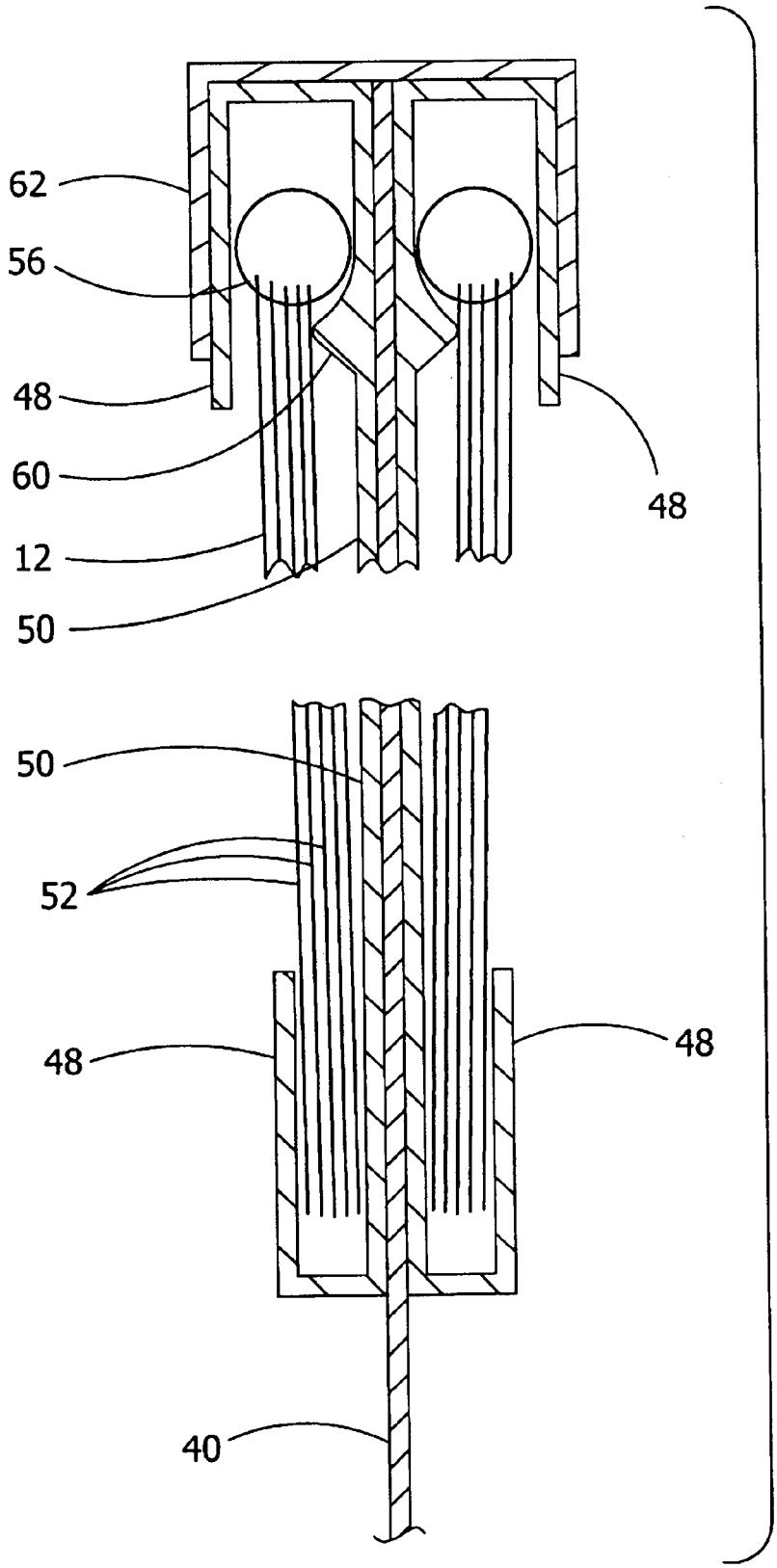
FIG. 4 is an enlarged, fragmentary detail of the sign holder of FIG. 3.

As shown in FIG. 4, a cap 62 is placed over the sign mount to protect the assembly and enhance the rigidity of the assembly. The cap 62 is made of extruded ABS plastic and is attached by chemically binding the cap to the tracks 48. Other materials and methods of attachment do not depart from the scope of this invention. The cap 62 also holds the upper track 48 securely in position against the base member 40.

In operation, the secondary sign holder 10 may replace a conventional divider which is typically placed between parallel, oppositely-facing first signs 14, 34. Significantly, the present invention may be fit into existing frames 18 to expand the size of information displayed. When a price fluctuates in value, interchangeable digit cards 52 may be quickly changed by sliding the old cards out from the tracks 48 and installing new cards reflecting the updated price. The secondary sign holder 10 is economical to manufacture and is reliable in operation. Further, the invention may be adapted to fit in locations of limited space as the dimensions and relative sizes of the components may be varied.

Figure 6:
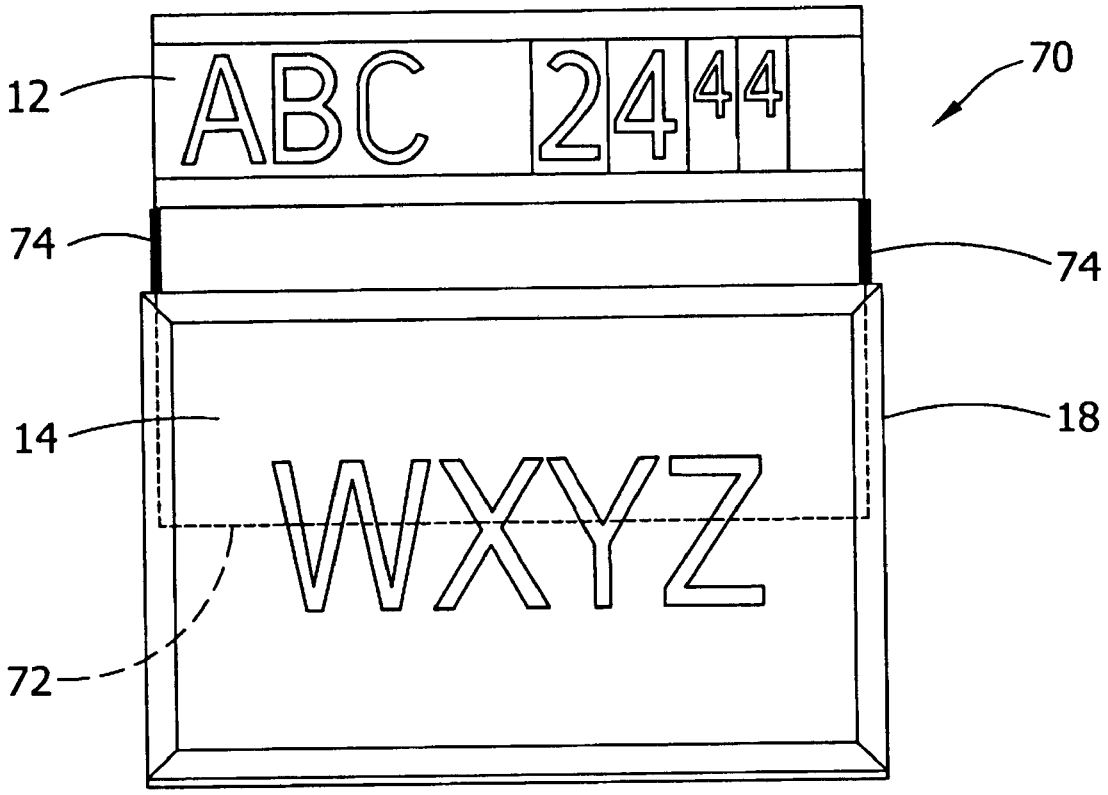
FIG. 6 is a front elevational view of a second embodiment of the sign holder.

A second embodiment 70 of the invention is shown in FIG. 6. The base member 40 is placed at a retained position where a bottom edge 72 of the base member remains spaced above the bottom member 24 of the frame 18. A support comprising two clips 74 is placed along the base member 40 beneath the tracks 48. The clips 74 are channel shaped strips of rigid plastic or metal which clip to the base member and function as spacers between the lower track 48 and frame 18. The clips are preferably positioned on lateral edges of the base member 40, engaging the lower track. When the base member 40 is inserted in the opening 32 of the frame 18, the clips 74 (which are larger than the opening 32) engage the top of the frame and come to rest on the top of the frame. The weight of the secondary sign holder 10 is supported through the lower track 48 by the clips 74. It is understood that mechanisms other than clips for supporting the secondary sign holder 10 at an elevated position do not depart from the scope of this invention. For example, a support positioned at a different location on the panel (other than the lateral edges and engaging the lower track) does not depart from the scope of this invention.

Figure 7:
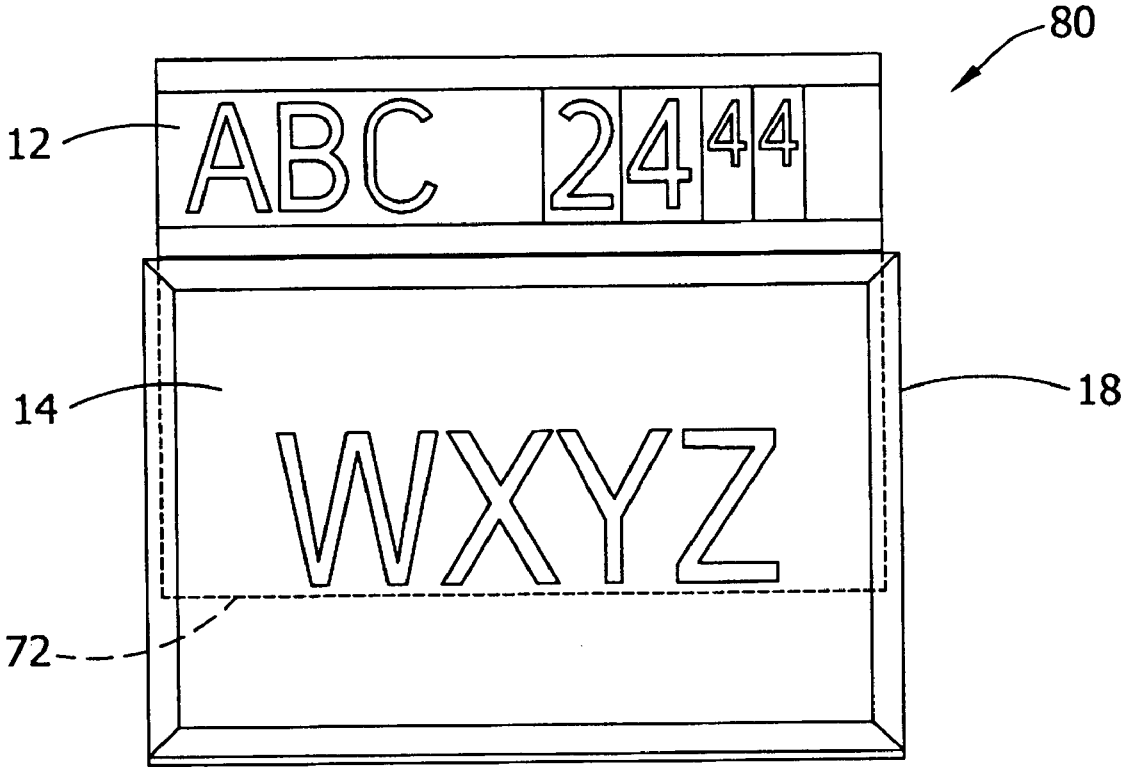
FIG. 7 is a front elevational view of a third embodiment of the sign holder.

A third embodiment 80 of the invention is shown in FIG. 7. The base member 40 is sized such that when it is inserted in the opening 32 of the frame 18, the bottom edge 72 of the base member remains spaced above the bottom member 24 of the frame. A bottom surface of the lower track 48 directly engages the top of the frame and rests on the top of the frame. The weight of the secondary sign holder 10 is supported through the lower track 48. The third embodiment 80 has a decreased total height and is particularly suitable for placing at a location with a vertical height constraint.

A fourth embodiment (not shown) of the present invention includes a vertical rod (not shown) placed adjacent to a side member 20 of the frame 18 with a hinge at a top of the rod for pivotally moving the secondary sign holder into or out of position above the primary sign holder. Alternatively, the second sign may be folded or hinged such that it is pivotally movable between a stowed position (not shown) and a deployed position above the primary sign holder.

In view of the above, it will be seen that the several objects of the invention are achieved and other advantageous results obtained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A secondary sign holder for displaying a second sign at a position adjacent a primary sign holder for displaying a first sign and which facilitates readily changing the second sign to alter the information displayed by the secondary sign holder, the primary sign holder including a frame for supporting the first sign generally within a boundary defined by the frame, the secondary sign holder comprising:

a base member including a rigid support portion and a display portion, the rigid support portion being sized and shaped for reception by said frame of the primary sign holder for holding the secondary sign holder in an upright orientation with the display portion disposed generally adjacent to the primary sign holder and outside said boundary of the frame whereby the secondary sign holder enlarges a size of space for displaying information; and a sign mount on the display portion of the base member for mounting said second sign on the secondary sign holder to display the second sign, the sign mount being configured for selectively interchanging the second sign with a different second sign to change the information displayed without altering the first sign.

2. A holder as set forth in claim 1 wherein said rigid support portion of the base member and said display portion of the base member are integral and define a generally flat panel.

3. A holder as set forth in claim 2 wherein said base member is sized with a height greater than said frame of the primary sign holder so that when said support portion is received by the frame, the display portion of the base member extends above a top of the frame.

4. A holder as set forth in claim 2 wherein said panel is continuous and solid.

5. A holder as set forth in claim 4 wherein the base member is rectangular in shape.

6. A holder as set forth in claim 5 wherein the base member is made of a metallic material.

7. A holder as set forth in claim 1 wherein said sign mount comprises spaced apart tracks mounted on the display portion of the base member for slidably receiving said second sign between the tracks.

8. A holder as set forth in claim 7 wherein the tracks are arranged in a vertically spaced relation.

9. A holder as set forth in claim 8 wherein the tracks each define a generally channel shape opening which opens laterally outwardly on least at one end for slidably receiving the second sign.

10. A holder as set forth in claim 9 wherein the tracks constitute first upper and lower tracks, and wherein the holder further comprises second upper and lower tracks mounted on a side of the display portion opposite a side on which the first tracks are mounted.

11. A holder as set forth in claim 9 further comprising a bump-shaped positioning formation on the sign mount engageable by the second sign for positioning the second sign.

12. A holder as set forth in claim 1 in combination with said second sign, and wherein the second sign comprises a plurality of interchangeable cards, each card displaying an individual numeric digit for indicating price.

13. A holder as set forth in claim 12 wherein each of said cards are bound in a set with other cards showing other numeric digits, and wherein said sign mount comprises spaced apart tracks mounted on the display portion of the base member for slidably receiving each set between the tracks.

14. A holder as set forth in claim 1 wherein the secondary sign holder is held at a position with the support portion disposed behind the first sign so that visibility to the first sign is not obstructed by the support portion.

15. In combination, a primary sign holder for displaying a first sign and a secondary sign holder for displaying a second sign at a position adjacent the primary sign holder, the primary sign holder comprising:

a frame for supporting said first sign generally within a boundary defined by the frame, the frame having a top, a bottom, and an opening therein for receiving the first sign;

the secondary sign holder comprising:

a base member including a rigid support portion and a display portion, the rigid support portion being sized and shaped for reception by said frame and through said opening for holding the secondary sign holder in an upright orientation with the display portion disposed immediately adjacent to the primary sign holder outside said boundary of the frame whereby the secondary sign holder enlarges a size of space for displaying information; and a sign mount on the display portion of the base member for mounting said second sign on the secondary sign holder to display the second sign, the sign mount being configured for readily interchanging the second sign with a different second sign to change the information displayed without altering the first sign.

16. A combination as set forth in claim 15 wherein said opening in the frame is located in the top of the frame.

17. A combination as set forth in claim 16 wherein said opening comprises a slot extending along the top of the frame.

18. A combination as set forth in claim 16 wherein said base member is configured for being received by the frame at a retained position wherein the support portion extends downwardly to the bottom of the frame for support therefrom.

19. A combination as set forth in claim 18 wherein said base member is sized with a height greater than said frame such that when said base member is at said retained position, the display portion of the base member extends above the top of the frame.

20. A combination as set forth in claim 15 wherein the sign mount further comprises vertically spaced upper and lower tracks mounted on the display portion of the base member for slidably receiving said second sign between the tracks, each of the tracks defining a generally channel shape opening which opens laterally outwardly on least at one end for slidably receiving the second sign, and a bump-shaped positioning formation on the sign mount engageable by the second sign for positioning the second sign.

21. A holder for displaying a second sign at a position adjacent a first sign and which facilitates readily changing the second sign to alter the information displayed on the second sign, the first sign being supported by a frame having a top, a bottom, and an opening in the top of the frame, the first sign being received in the frame, the holder comprising:

a solid, rectangular, and generally flat panel configured to be received through said opening in the top of the frame to a retained position wherein the panel is at an upright orientation with a lower portion of the panel received in the frame and located behind said first sign so that visibility of the first sign is not obstructed by the panel and with an upper portion of the panel extending above the top of the frame, said panel having a bottom edge which at the retained position is spaced above said bottom of the frame;

upper and lower horizontal, spaced apart tracks on said upper portion of the panel configured for slidably receiving said second sign to display the second sign, the tracks configured for selectively interchanging the second sign with a different second sign to change the information displayed without altering the first sign; and wherein the lower track comprises a support for holding said panel at said retained position, the lower track configured for directly engaging the top of the frame to support the panel such that weight of the panel bears upon the top of the frame.

* * * * *